US009460878B2

(12) United States Patent
Totsuka et al.

(10) Patent No.: US 9,460,878 B2
(45) Date of Patent: Oct. 4, 2016

(54) FUSE UNIT

(71) Applicant: YAZAKI CORPORATION, Minato-ku, Tokyo (JP)

(72) Inventors: Mitsuhiko Totsuka, Shizuoka (JP); Toshiko Masuda, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 30 days.

(21) Appl. No.: 14/602,561

(22) Filed: Jan. 22, 2015

(65) Prior Publication Data

US 2015/0130584 A1 May 14, 2015

Related U.S. Application Data

(63) Continuation of application No. PCT/JP2013/068223, filed on Jul. 3, 2013.

(30) Foreign Application Priority Data

Jul. 23, 2012 (JP) ..... 2012-162354

(51) Int. Cl.
*H01H 45/02* (2006.01)
*H01H 85/12* (2006.01)
(Continued)

(52) U.S. Cl.
CPC ..... *H01H 45/02* (2013.01); *H01H 61/04* (2013.01); *H01H 85/044* (2013.01); *H01H 85/12* (2013.01);
(Continued)

(58) Field of Classification Search
CPC .. H01H 85/47; H01H 85/143; H01H 85/175; H01H 69/02
USPC ..... 337/186, 187, 190
See application file for complete search history.

(56) References Cited

U.S. PATENT DOCUMENTS 6,448,882 B1 * 9/2002 Inaba ..... H01H 85/044 337/159
6,509,824 B2 * 1/2003 Inaba ..... H01H 85/044 29/623

(Continued)

FOREIGN PATENT DOCUMENTS

CN 101578679 A 11/2009
CN 101728138 A 6/2010

(Continued)

OTHER PUBLICATIONS

The Japanese office action issued on Apr. 5, 2016 in the counterpart Japanese patent application.

(Continued)

*Primary Examiner* — Anthony Haughton
(74) *Attorney, Agent, or Firm* — Mots Law, PLLC

(57) ABSTRACT

A fuse unit comprising a resin housing formed by insulator, a circuit body formed by conductor, molded integrally with the resin housing and branching and transferring electricity from a power source side to a load side, and a fusible body provided on the circuit body and fusing at overcurrent to the load side; the circuit body is formed by a block side circuit body connected to the power source side, and a block side terminal body connected to the load side, a block side first connection end to which one side of the fusible body is detachably connected is formed on the block side circuit body, and a block side second connection end to which the other side of the fusible body is detachably connected is formed on the block side terminal body.

3 Claims, 5 Drawing Sheets

(51) Int. Cl.

| | |
|---|---|
| ***H01H 85/044*** | (2006.01) |
| ***H01H 85/143*** | (2006.01) |
| ***H01H 61/04*** | (2006.01) |
| *H01H 85/153* | (2006.01) |
| *H01H 85/02* | (2006.01) |
| *H01H 85/055* | (2006.01) |

(52) U.S. Cl.
CPC ..... *H01H 85/143* (2013.01); *H01H 85/153* (2013.01); *H01H 2085/025* (2013.01); *H01H 2085/0555* (2013.01)

(56) References Cited

U.S. PATENT DOCUMENTS

| | | | | |
|---|---|---|---|---|
| 6,759,938 | B2 * | 7/2004 | Matsumura | H01H 85/044 337/161 |
| 6,806,421 | B2 * | 10/2004 | Matsumura | H01H 85/044 174/50 |
| 6,824,430 | B2 * | 11/2004 | Matsumura | H01H 85/044 439/620.29 |
| 6,830,482 | B2 * | 12/2004 | Matsumura | H01H 85/044 29/623 |
| 9,287,076 | B2 * | 3/2016 | Kudo | H01H 85/044 |
| 9,324,531 | B2 * | 4/2016 | Kibushi | H01H 85/044 |
| 2001/0002812 | A1 * | 6/2001 | Sumida | H01H 85/044 337/227 |
| 2010/0060407 | A1 * | 3/2010 | Iwata | H01H 69/02 337/227 |
| 2012/0073125 | A1 | 3/2012 | Iwata et al. | |
| 2012/0326832 | A1 | 12/2012 | Iwata et al. | |

FOREIGN PATENT DOCUMENTS

| | | | |
|---|---|---|---|
| CN | 101937816 | A | 1/2011 |
| JP | 2002-150917 | A | 5/2002 |
| JP | 2010-062085 | A | 3/2010 |
| KR | 10-2011-0107169 | A | 9/2011 |

OTHER PUBLICATIONS

The Chinese office action letter issued on Jan. 6, 2016 in the counterpart Chinese patent application.
Official Action issued on Jun. 13, 2016 in the counterpart Korean application.

* cited by examiner

FUSE UNIT

CROSS REFERENCE TO RELATED APPLICATIONS

This application is a Continuation of PCT Application No. PCT/JP2013/068223, filed on Jul. 3, 2013, and claims the priority of Japanese Patent Application No. 2012-162354, filed on Jul. 23, 2012, the content of both of which is incorporated herein by reference.

TECHNICAL FIELD

The present invention relates to a fuse unit in which a fuse is incorporated into a conductive circuit body formed integrally with an insulating resin housing.

BACKGROUND ART

A fuse unit is proposed in which a conductive circuit body that has a bus bar with which a fuse element (fusible body) is integrally formed is molded integrally with an insulating resin housing, and the circuit body and the fusible body are embedded in the resin housing. Since, in this fuse unit, the fusible body is formed integrally with the circuit body, labor of connecting the fusible body to the circuit body is saved and assemblability is improved.

However, in the fuse unit in which the circuit body and the fusible body are integrally formed, when an electric current of a specified value or more (an overcurrent) flows and the fusible body fuses, it cannot be replaced with a substitute fusible body and the whole fuse unit should be replaced.

In addition, in a case where the circuit body and the fusible body are integrally formed, since it results in a fuse capacity of the same plate thickness as the plate thickness of the circuit body, that is, the same sectional area, the plate thickness cannot be thickened, that is, the sectional area cannot be largely taken in order to energize a fusible body for large current. Therefore, in the fuse unit having the circuit body which is integrally formed with the fusible body, a resistance value that is commensurate with a required fuse capacity cannot be set.

Accordingly, a fuse unit configured such that the fusible body is provided separately from the circuit body, and the fusible body for which the resistance value that is commensurate with the required fuse capacity is set is incorporated into the circuit body is proposed in Patent Literature 1. In this fuse unit, the separately provided fusible body is joined with the circuit body by various joining methods such as welding with solder, swaging, welding with ultrasonic waves, and welding with optical laser beams. In addition, in the fuse unit in this Patent Literature 1, an example is also proposed in which in a case where the fusible body has fused, the substitute fusible body can be fixed to a fixing part that is provided in advance on the fusible body.

CITATION LIST

Patent Literature

Patent Literature 1: Japanese Patent Laid-Open Publication No. 2010-62085

SUMMARY OF INVENTION

Technical Problem

However, although in the above-mentioned Patent Literature 1, although the fusible body for which the resistance that is commensurate with the required fuse capacity is set can be joined to the circuit body, the fusible body is joined to the circuit body by welding or swaging processing and therefore it cannot be detached readily when once joined, and in a case where the fusible body has fused with the overcurrent, it cannot be replaced with a new fusible body.

In addition, in a case where the fusible body for which the resistance value that is commensurate with the required fuse capacity is set is to be incorporated into the circuit body, welding work by a processing device for welding and swaging work by a swaging device for the swaging processing become necessary, the labor is taken for work of incorporating the fusible body, processes for the incorporating work become also necessary, and man-hours for manufacture are increased.

In addition, in a case where the substitute fusible body is fixed to the fixing part provided on the fusible body in advance, the rest of the fused fusible body remains in the fuse unit and it is feared that this rest may scatter and hit other fusible bodies.

Accordingly, the present invention aims to provide a fuse unit capable of incorporating the fusible body that is set to the resistance value commensurate with the required fuse capacity into the circuit body, readily removing the fused fusible body after the fusible body has fused, and readily incorporating the new fusible body.

Solution to Problem

A fuse unit of the present invention is a fuse unit including a resin housing that is formed by an insulator; a circuit body that is formed by a conductor, is molded integrally with the resin housing and branches and transfers electric power from a power source side to a load side; and a fusible body that is provided on the circuit body and fuses at overcurrent to the load side, wherein the circuit body is formed by a block side circuit body to be connected to the power source side, and a block side terminal body to be connected to the load side, a block side first connection end to which one side of the fusible body is to be detachably connected is formed on the block side circuit body, and a block side second connection end to which the other side of the fusible body is to be detachably connected is formed on the block side terminal body.

In the fuse unit of the present invention, it is preferable that each of the block side first connection end and the block side second connection end be formed by a cut-upright base part that is cut upright from the circuit body, and a cut-upright elastic part that is bent from this base part in a plane direction of the circuit body to insert one side of the fusible body into between the cut-upright elastic part and the circuit body so as to enable elastic nipping and holding.

In the fuse unit of the present invention, it is preferable that in the resin housing, the block side first connection end and the block side second connection end be contained, and a fusible body containing part that is exposed to outside is formed, and the fusible body containing part be provided with a cover including a front side element cover and a back side element cover that cover the fusible body containing part from the front surface side and the back surface side thereof.

In the fuse unit of the present invention, it is preferable that the block side first connection end and the block side second connection end be provided on a plurality of places and a plurality of the fusible bodies be connected thereto, the partition ribs respectively partition the adjacent block side first connection ends and respectively partition the adjacent block side second connection ends, and the partition ribs be respectively formed on the cover that includes the front side element cover and the back side element cover.

DESCRIPTION OF EMBODIMENTS

Figure 1B:
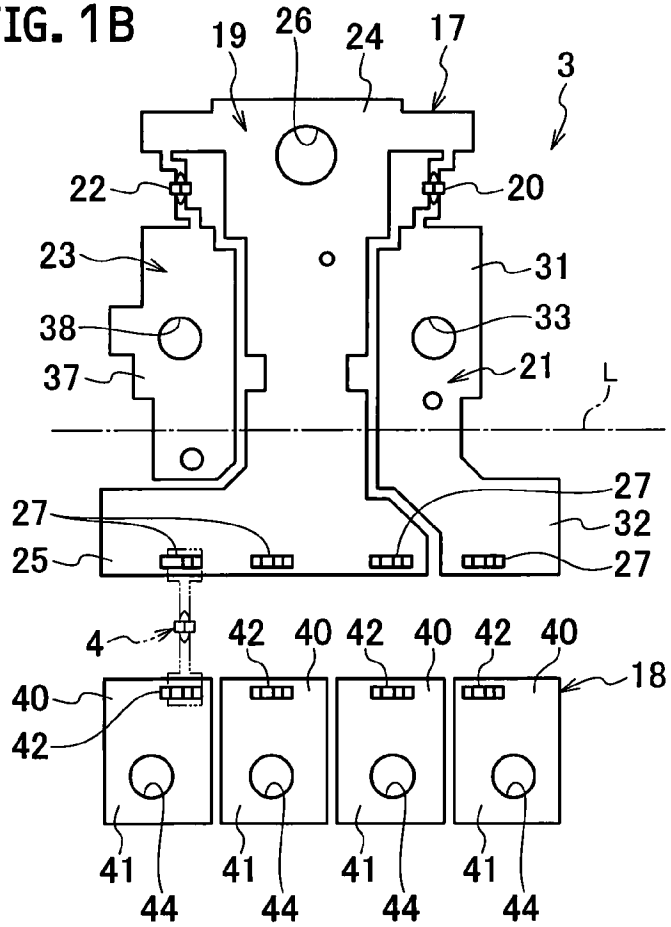
FIG. 1B is a plan view of a fuse unit in an embodiment of the present invention, showing the circuit body.
Figure 1A:
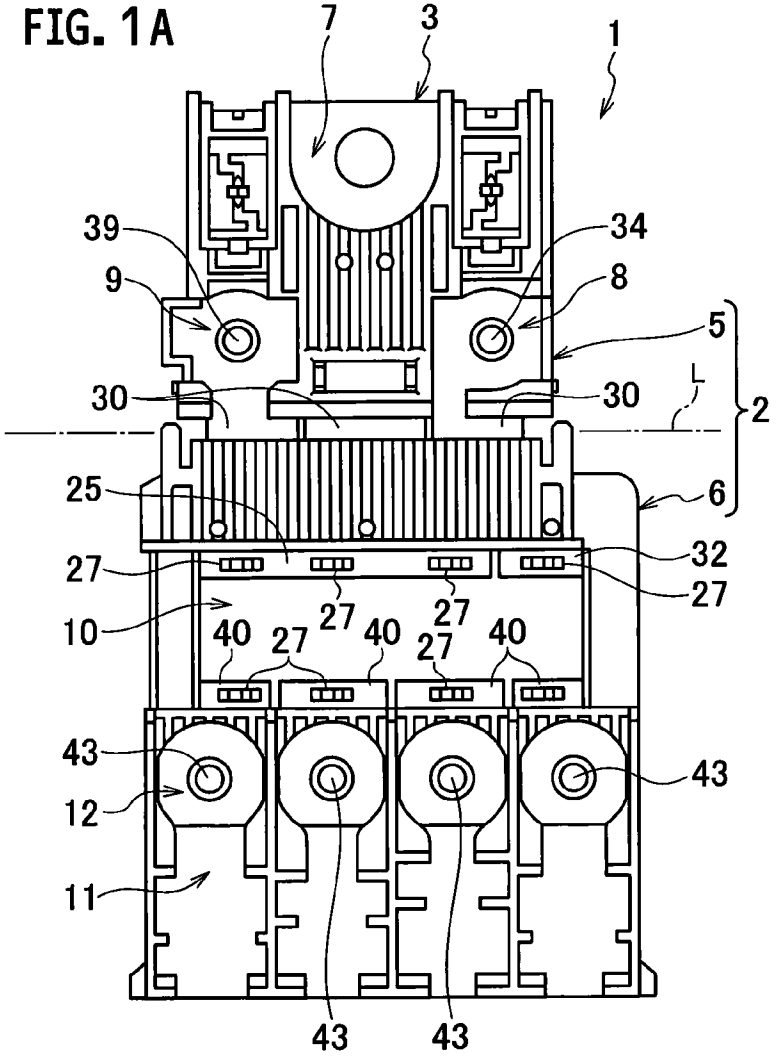
FIG. 1A is a plan view of a fuse unit in an embodiment of the present invention, showing a resin housing and a circuit body that is embedded in this resin housing.
Figure 2:
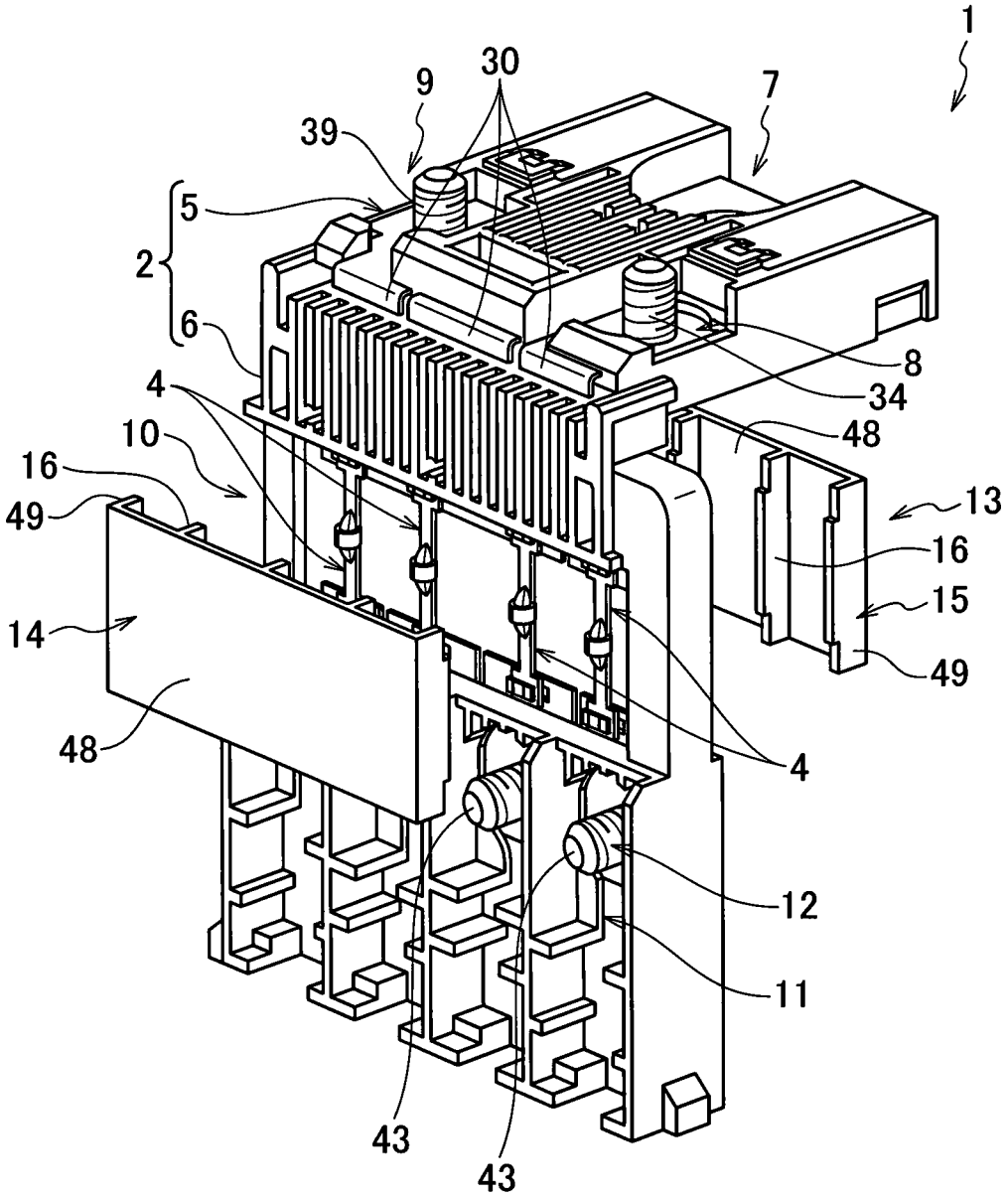
FIG. 2 is a perspective view showing the fuse unit in the embodiment of the present invention.
Figure 3:
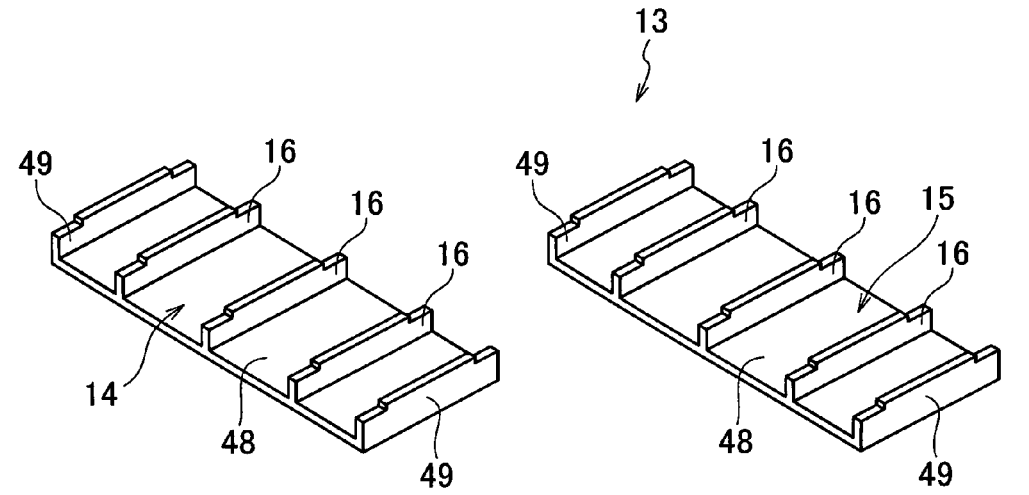
FIG. 3 is a plan view showing an element cover that covers a fusible body to be incorporated into the fuse unit in the embodiment of the present invention.
Figure 4:
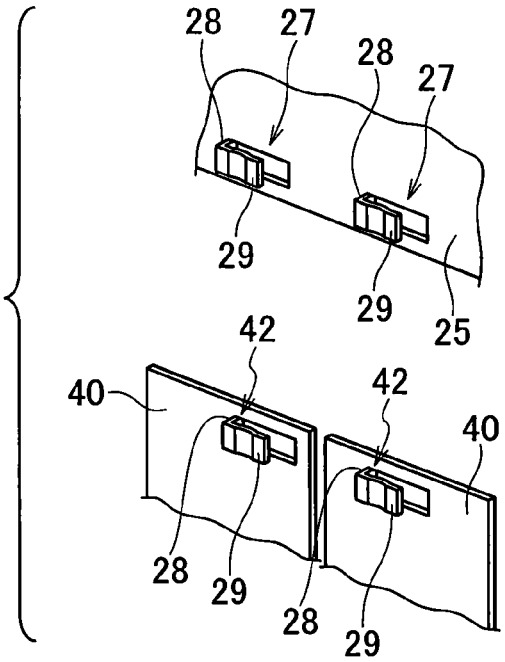
FIG. 4 is a perspective view showing a block side first connection end and a block side second connection end of the fuse unit.

In the following, embodiments of the present invention will be described on the basis of the drawings. As shown in FIG. 1A, FIG. 1B and FIG. 2, a fuse unit 1 of the present embodiment is provided with a resin housing 2 formed by an insulator, a circuit body 3 that is formed by a conductor, is molded integrally with the resin housing 2 and branches and transfers electric power from a power source side to a load side, and a fusible body 4 that is provided on this circuit body 3 and fuses at overcurrent to the load side. In addition, the circuit body 3 is formed by a block side circuit body 17 to be connected to the power source side, and a block side terminal body 18 to be connected to the load side, block side first connection end 25, 32 to which fusible body side first connection ends 45 of the fusible bodies 4 are to be detachably connected are formed on the block side circuit body 17, and a block side second connection end 40 to which a fusible body side second connection end 46 of the fusible body 4 is to be detachably connected is formed on the block side terminal body 18.

The above-mentioned resin housing 2 is formed by a first block 5 to be placed on an upper surface side of a power source (a battery), and a second block 6 located on a side surface of the battery.

In the first block 5, a first battery connection part 7 to be connected with a battery post, an alternator connection part 8 to which a terminal of a cable terminal from an alternator is to be connected, and a second battery connection part 9 to which a terminal of a cable terminal from a second battery is to be connected are provided. On these first battery connection part 7, alternator connection part 8 and second battery connection part 9, later described first battery connector 19, alternator connector 21, and second battery connector 23 of the circuit body 3 that have been molded integrally with the resin housing 2 and embedded therein are provided so as to be partially exposed.

In the second block 6, a fusible body containing part 10, and a load side connection part 11 are provided. On the fusible body containing part 10, the block side first connection ends 25, 32 and the block side second connection end 40 of the circuit body 3 are provided leaving predetermined spaces in a state of being exposed to the outside. The fusible bodies 4 are to be incorporated into between these block side first connection ends 25, 32 and the block side second connection ends 40. In the present embodiment, the four fusible bodies 4, 4, 4, 4 are to be incorporated. On the load side connection parts 11, a plurality of places of screw clamp parts 12 to which the terminals of the cable terminal from the load side are to be screw-clamped and connected is formed. On these screw clamp parts 12, parts of the block side terminal bodies 18 of the circuit body 3 are exposed to the outside. Then, the terminals of the cable terminal from the load side are screw-clamped with the exposed block side terminal bodies 18, thereby the circuit body 3 and the load side are connected together, and the electric power is supplied from the power source to the load side via the circuit body. In the present embodiment, this screw-clamp part 12 is installed on four places corresponding to the four fusible bodies 4, 4, 4, 4.

In addition, the fusible body containing part 10 of the second block 6 is covered with a transparent cover 13. This cover 13 is configured by a front side element cover 14, and a back side element cover 15 and is attached to the second block 6 so as to nip the fusible body containing part 10 from the front surface side and the back surface side of the fusible body containing part 10. The front side element cover 14, and the back side element cover 15 are formed by a transparent material into almost the same shape, and formed by a tabular cover wall 48, side walls 49, 49 formed by being bent from the both sides of this cover wall 48 in the same direction, and three partition ribs 16, 16, 16 provided on the inner sides of the side walls 49, 49 at equal intervals. The partition ribs 16, 16, 16 of the front side element cover 14, and the back side element cover 15 mutually abut in a state of covering the fusible body containing part 10 and partition the four fusible bodies 4, 4, 4, 4. At that time, they partition the block side first connection ends 25 and 32 of the circuit body 3 into four places and partition the block side second connection ends 40 into four places.

The conductive circuit body 3 is molded integrally with the resin housing 2 that includes the above-mentioned first block 5 and second block 6 as mentioned above. The resin housing 2 that has been molded integrally with the circuit body 3 is molded into an almost planar shape as shown in FIG. 1A, and the L-letter shaped fuse unit 1 is formed as shown in FIG. 2 by bending it almost at a right angle along a bending line L on an exposed part 30 of the circuit body 3 provided between the first block 5 and the second block 6.

Figure 5:
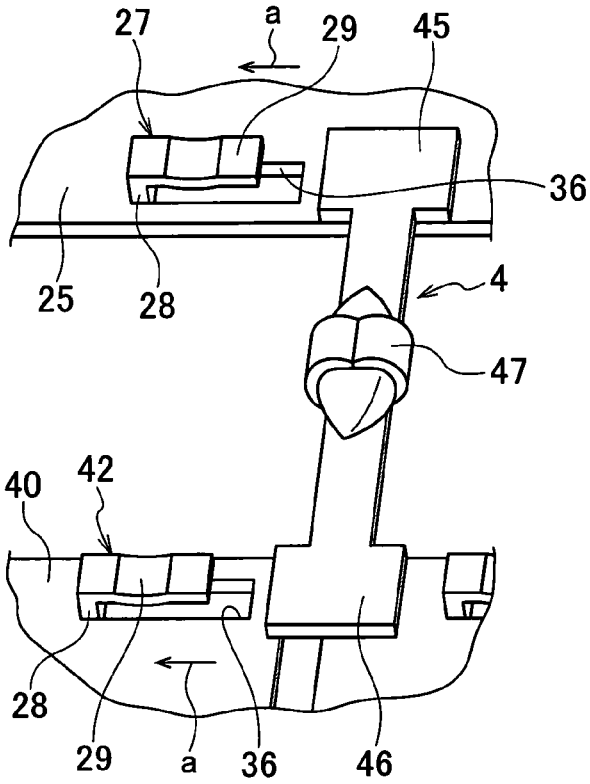
FIG. 5 is a perspective view showing a state of incorporating the fusible body into the block side first connection end and the block side second connection end of the fuse unit.

Next, the conductive circuit body 3 to be molded integrally with the resin housing 2 that includes the first block 5 and the second block 6 will be described. The separately provided fusible body 4 is to be incorporated into this circuit body 3. As shown in FIG. 2 and FIG. 5, the fusible body 4 is formed by the rectangular fusible body side first connection end 45 and fusible body side second connection end 46 that are formed on the both sides, and a fusible part 47 that is provided between these fusible body side first connection end 45 and fusible body side second connection end 46 and tin-welded. The fusible part 47 fuses when the current (overcurrent) exceeding the capacity as the fuse element flows between the fusible body side first connection end 45 and the fusible body side second connection end 46.

The circuit body 3 into which this fusible body 4 is to be incorporated is formed by stamping out a conductor sheet material as shown in FIG. 1B and is formed by the block side circuit body 17 whose most part is molded integrally with the first block 5 and embedded, and the block side terminal body 18 that is molded integrally with the second block 6 and embedded.

The block side circuit body 17 is formed by the first battery connector 19, the alternator connector 21 connected with this first battery connector 19 via the fusible part 20 and arranged on one side of the first battery connector 19, and the second battery connector 23 connected with the first battery connector 19 via the fusible part 22 and arranged on the other side of the first battery connector 19.

On the first battery connector 19, a first battery connection end 24 provided on one side, and the block side first connection end 25 provided on the other side are formed. The first battery connection end 24 is arranged in a state of exposing to the first battery connection part 7 of the first block 5 as mentioned above and a post on an upper surface of the battery is inserted into a through-hole 26 and is screw-clamped, thereby the battery and the block side circuit body 17 are connected together.

The block side first connection end 25 is arranged in the state of exposing to the fusible body containing part 10 as mentioned above and a block side first connection part 27 to which one side of the fusible body 4 is to be detachably assembled is provided on three places thereof. The block side first connection part 27 is formed by a cut-upright base part 28 that is cut upright from the block side first connection end 25 of the circuit body 3, and a cut-upright elastic part 29 that is bent from this base part 28 in a plane direction of the circuit body 3. Then, one side of the fusible body 4 is elastically nipped and held by inserting the fusible body side first connection end 45 into between the cut-upright elastic part 29 and the block side first connection end 25 as shown in FIG. 5. In this case, one side of the fusible body 4 is slid into between the cut-upright elastic part 29 and the block side first connection end 25 by directing toward the base part 28 side, thereby it can be elastically nipped and held between the cut-upright elastic part 29 and the block side first connection end 25.

Incidentally, the areas of the fusible body side first connection end 45 and the fusible body side second connection end 46 on the both sides of the fusible body 4 are set larger than the size of a rectangular through-hole 36 formed after the cut-upright base part 28 and the cut-upright elastic part 29 have been cut upright from the block side first connection end 25, and the through-hole 36 is covered and the periphery of an opening edge of the through-hole 36 and the fusible body side first connection end 45, the fusible body side second connection end 46 are in contact with each other having a predetermined contact surface in a state that the fusible body 4 has been assembled.

A connection part with a fusible part 20 is formed on one side of the alternator connector 21 arranged adjacent to the above-mentioned first battery connector 19, an alternator connection end 31 to which the cable terminal from the alternator is to be connected is formed on its intermediate part, and the block side first connection end 32 is formed on its other side. A through-hole 33 is provided in the alternator connection end 31 and a screw 34 arranged upright on the first block 5 passes through this through-hole 33. The alternator and the alternator connector 21 are connected together by inserting this screw 34 into the terminal of the cable terminal from the alternator side and co-fastening them with a nut. The block side first connection end 32 is arranged adjacent to the block side first connection end 25 of the first battery connector 19, the cut-upright base part 28 and the cut-upright elastic part 29 are formed similarly to the block side first connection part 27 provided on the block side first connection end 32, and one side of the fusible body 4 can be elastically nipped and held between the cut-upright elastic part 29 and the block side first connection end 32.

A connection part with the fusible part 22 is formed on one side of the second battery connector 23 that is arranged on the opposite side of the alternator connector 21 with the above-mentioned first battery connector 19 interposed between them, and a second battery connection end 37 to which the cable terminal from the second battery is to be connected is formed on its intermediate part. A through-hole 38 is provided in the second battery connection end 37, and a screw 39 arranged upright on the first block 5 passes through this through-hole 38. The second battery and the second battery connector 23 are connected together by inserting this screw 39 into the terminal of the cable terminal from the second battery and co-fastening them with a nut.

The block side terminal body 18 is formed by four rectangular conductors, the block side second connection ends 40 are respectively provided on their one sides and the load side connection ends 41 are respectively provided on their other ends. The block side second connection ends 40 are respectively arranged in the state of exposing to the fusible body containing part 10 and are provided with the block side second connection parts 42 to which the other ends of the fusible bodies 4 are to be detachably assembled respectively. The block side second connection part 42 is formed by the cut-upright base part 28 and the cut-upright elastic part 29 that has been extended from this cut-upright base part 28 similarly to the block side first connection part 27 provided on the block side first connection end 25, 32. The fusible body side second connection end 46 of the fusible body 4 can be connected to the block side second connection end 40 by inserting the fusible body side second connection end 46 of the fusible body 4 into between the cut-upright elastic part 29 and the block side second connection end 40 and elastically nipping and holding it.

A load side connection end 41 is arranged exposing to a screw clamp part 12 of the second block 6 and a through-hole 44 into which a screw 43 provided on the screw clamp part 12 is to be inserted is provided therein. By assembling the terminal of the cable terminal from the load side to this screw clamp part 12 and co-fastening them with a nut, the load side connection end 41 and the load side are connected together, and the first battery connection end 24, the alternator connection end 31 and the load side are connected together via the fusible body 4 incorporated into the fusible body containing part 10 and the electric power is supplied.

In order to manufacture the fuse unit 1 of the above-mentioned configuration, the circuit body 3 shown in FIG. 1B is formed in advance by stamping out from the sheet material and this circuit body 3 is molded integrally with the resin housing 2 as shown in FIG. 1A. In this case, the most of the block side circuit body 17 is embedded in the first block 5 and they are integrally molded in a state that the exposed part 30 is left exposed, and one part of the block side circuit body 17 and the block side terminal body 18 are molded integrally with the second block 6 such that the block side first connection ends 25, 32 and the block side second connection ends 40 are located on the fusible body containing part 10. In this integral molding, the fuse unit 1 is formed into the planar shape as shown in FIG. 1A.

Next, as shown in FIG. 2, the fuse unit 1 is bent almost at a right angle along the bending line L on the exposed part 30 of the circuit body 3. The fusible body 4 is incorporated into between the block side first connection end 25, 32 and the block side second connection end 40 from this state. In this case, as shown in FIG. 5, it is slidingly moved (in an arrow a direction) toward the cut-upright base part 28 side in a state that the fusible body side first connection end 45 and the fusible body side second connection end 46 of the fusible body 4 are held in abutment on the block side first connection end 25, 32 and the block side second connection end 40. Thereby, it can be elastically nipped and held between the cut-upright elastic part 29 and the block side first connection end 25, 32 and between the cut-upright elastic part 29 and the block side second connection end 40. In addition, although in a case of the fusible body 4 that is made different in fuse capacity, the thicknesses of the fusible body side first connection end 45 and the fusible body side second connection end 46 are made different, it can be elastically nipped and held by the elastic force of the cut-upright elastic part 29 also in a case where the thicknesses are made different.

In addition, also in a case of replacing the fusible body 4 with another fusible body 4, the fusible body 4 can be readily detached by slidingly moving (a direction reverse to the arrow a direction) it in a direction away from the cut-upright base part 28.

The fuse unit 1 is completed by covering the fusible body containing part 10 with the cover 13 after the fusible body 4 of the required capacity has been assembled to and contained in the fusible body containing part 10 as described above.

As described hereinabove, in the fuse unit 1 of the present embodiment, the fusible body 4 can be incorporated into the circuit body 3 by connecting the fusible body side first connection end 45 of the fusible body 4 to the block side first connection end 25, 32 and by connecting the fusible body side second connection end 46 of the fusible body 4 to the block side second connection end 40. In this case, since the fusible body 4 is made detachable relative to the block side first connection end 25, 32, and the block side second connection end 40, the fusible body 4 that has been set to the resistance value commensurate with the required fuse capacity can be readily incorporated into the circuit body 3.

In addition, the fusible body that has fused after the fusible body 4 has fused can be readily removed, and also in a case where the new fusible body 4 is to be incorporated into the circuit body 3, the fusible body can be readily incorporated into the block side first connection end 25, 32 and the block side second connection end 40 in comparison with joining of the fusible body 4 by welding, swaging and so forth.

In addition, since the fusible body 4 can be incorporated into the circuit body 3 by inserting the fusible body side first connection end 45 of the fusible body 4 into between the cut-upright elastic part 29 and the block side first connection end 25, 32 so as to make them elastically nip and hold it, and by inserting the fusible body side second connection end 46 of the fusible body 4 into between the cut-upright elastic part 29 and the block side second connection end 40 so as to make them elastically nip and hold it, the fusible body 4 can be readily incorporated into the circuit body 3.

Further, also in a case where the fusible body 4 fuses with overcurrent and is to be replaced with the new fusible body 4, since the fusible body 4 that has fused and has been damaged may be removed from between the cut-upright elastic part 29 and the block side first connection end 25, 32, the block side second connection end 40 and the substitute fusible body 4 may be inserted into between the cut-upright elastic part 29 and the block side first connection end 25, 32, the block side second connection end 40 so as to make them elastically nip and hold it, work of replacing the fusible body 4 can be readily performed.

Further, since the fusible body 4 that has been incorporated into the block side first connection end 25, 32 and the block side second connection end 40 contained in the fusible body containing part 10 is covered with the front side element cover 14 and the back side element cover 15, even when the fusible body 4 fuses with the overcurrent and so forth, a broken piece thereof does not scatter to the outside.

In addition, since the adjacent block side first connection ends 25 and 32 are mutually partitioned and the adjacent block side second connection ends 40 are mutually partitioned by the partition ribs 16, 16, 16 in a state that the fusible bodies 4 that have been incorporated into the block side first connection ends 25 and 32 and the block side second connection ends 40 contained in the fusible body containing part 10 are covered with the front side element cover 14 and the back side element cover 15, even when one fusible body 4 has fused, the broken piece thereof does not scatter toward the adjacent fusible body 4 side and the adjacent fusible body 4 does not fuse needlessly.

Incidentally, although in the above-mentioned embodiment, an example is shown in which the block side first connection part 27 and the block side second connection part 42 including the cut-upright base parts 28 and the cut-upright elastic parts 29 are provided on the block side first connection end 25, 32 and the block side second connection end 40 that are provided exposing to the fusible body containing part 10, as the configurations of the block side first connection part 27 and the block side second connection part 42, various configurations can be used, not limited to the example in the present embodiment.

Figure 6:
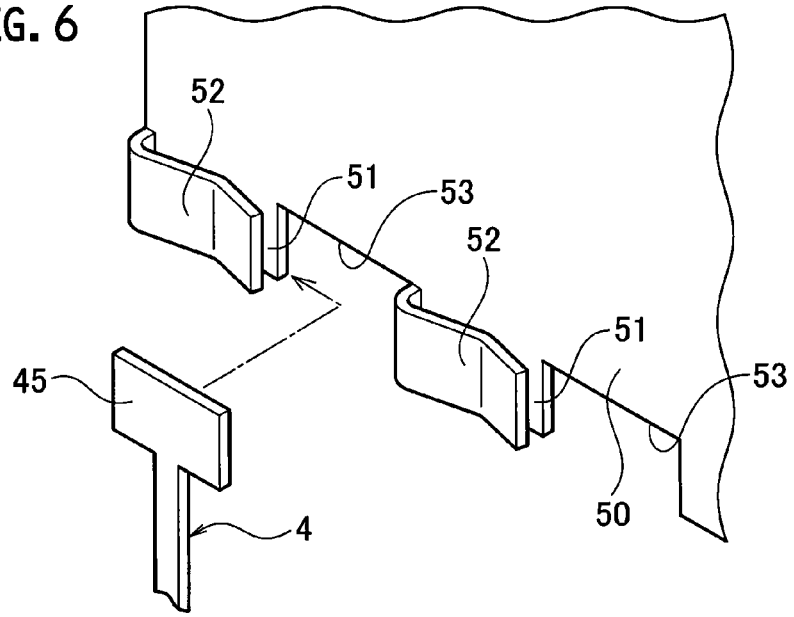
FIG. 6 is a perspective view showing a block side first connection end of another embodiment.
Figure 7:
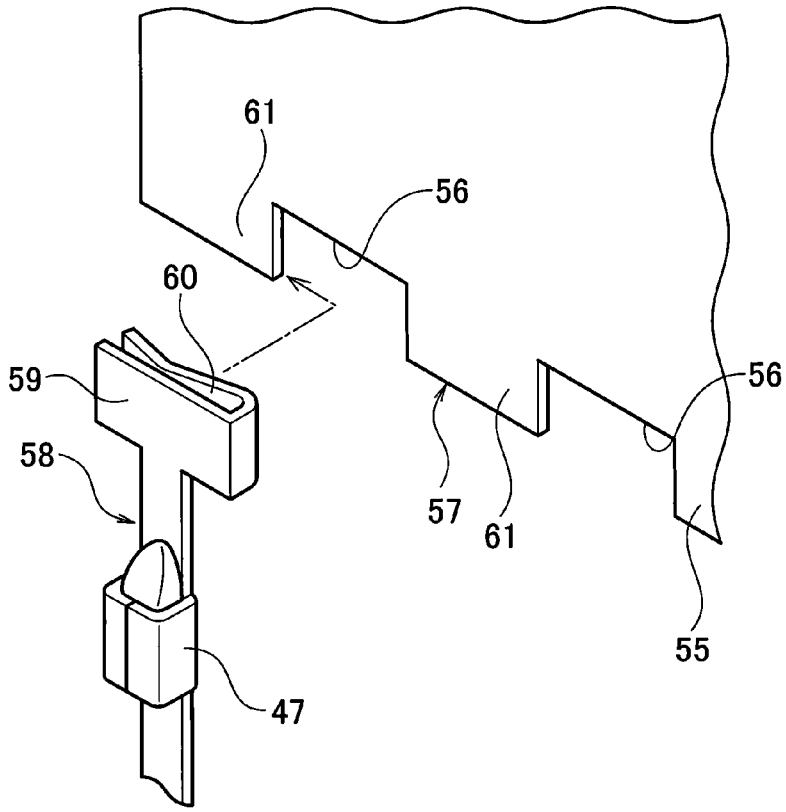
FIG. 7 is a perspective view showing a block side first connection end of another embodiment, and showing an example in which an elastic nipping and holding piece is provided on a first connection end of the fusible body.

Next, other examples of block side first connection ends shown in FIG. 6 and FIG. 7 will be described. With respect to the same constitutional parts as those in the above-mentioned embodiment, the same symbols are assigned thereto in the drawings, and description of the same constitutional parts as those in the above-mentioned embodiment is omitted.

On a block side first connection end 50 of the present embodiment, an elastic nipping and holding piece 52 is formed which is obtained by notching an outer peripheral end 51 of the block side first connection end 50 into a rectangular shape and bending it toward the outer peripheral end side. The fusible body side first connection end 45 of the fusible body 4 can be inserted from between the leading end side of this elastic nipping and holding piece 52 and the outer peripheral end 51. In addition, the elastic nipping and holding piece 52 is formed to be arched toward the outer peripheral end 51 side on its central part ranging from a part contiguous to the outer peripheral end 51 to the leading end side and can elastically nip and hold the fusible body side first connection end 45 of the inserted fusible body 4. Further, the fusible body side first connection end 45 of the fusible body 4 can be readily detached by slidingly moving the fusible body side first connection end 45 of the fusible body 4 that has been inserted into between the elastic nipping and holding piece 52 and the outer peripheral end 51 toward the notched part 53 side of the outer peripheral end 51. In addition, even when the thickness of the fusible body side first connection end 45 of the fusible body 4 is made different, it can be inserted into between the elastic nipping and holding piece 52 and the outer peripheral end 51. Therefore, the fusible body 4 can be detachably connected to the block side first connection end 50 (the block side second connection end). Incidentally, the fusible body 4 can be detachably connected to the circuit body 3 by providing the same elastic nipping and holding piece 52 as that of the above-mentioned block side first connection end 50 also on the block side second connection end.

The same effect as that of the embodiment described in FIGS. 1A, 1B, 2, 3, 4, and 5 can be obtained on the block side first connection end of the present embodiment by making it have the above-mentioned configuration.

Next, a block side first connection end 55 shown in FIG. 7 will be described. As shown in FIG. 7, on the block side first connection end 55, a rectangular notch 56 is formed in an outer peripheral end 57 of the block side first connection end 55. On the other hand, on a fusible body side first connection end 59 of a fusible body 58, an elastic nipping and holding piece 60 that has been extended from one side of the fusible body side first connection end 59 and folded back toward the back surface side of the fusible body side first connection end 59 is formed. A side wall end 61 that forms the notch 56 is made insertable into between the back surface side of the fusible body side first connection end 59 and the elastic nipping and holding piece 60.

Then, the fusible body 58 can be connected to the block side first connection end 55 by inserting the side wall end 61 of the notch 56 into between the elastic nipping and holding piece 60 and the fusible body side first connection end 59 of the fusible body 58. In this case, the side wall end 61 can be readily inserted into between the back surface side of the fusible body side first connection end 59 and the elastic nipping and holding piece 60 of the fusible body 58 by slidingly moving the fusible body side first connection end 59 of the fusible body 58 toward the side wall end 61 side in a state of leaving the fusible body side first connection end 59 of the fusible body 58 located in the notch 56. In this state, the side wall end 61 is elastically nipped and held between the back surface side of the fusible body side first connection end 59 and the elastic nipping and holding piece 60 of the fusible body 58. In addition, in a case where the fusible body 58 is to be removed, the fusible body 58 can be readily detached from the block side first connection end 55 by sliding the fusible body side first connection end 59 of the fusible body 58 toward the notch 56 side. Further, even in a case where the thickness of the fusible body side first connection end 59 of the fusible body 58 is made different, it can be connected (assembled) to the block side first connection end 55 by providing the elastic nipping and holding piece 60 on the fusible body side first connection end 59 of the fusible body 58. Incidentally, the fusible body 58 can be detachably and readily connected to the circuit body 3 by providing a rectangular notch in the block side second connection end similarly to the block side first connection end 55 and providing the same elastic nipping and holding piece 60 also on the fusible body side second connection end of the fusible body 58.

The same effect as that of the embodiment described in FIGS. 1A, 1B, 2, 3, 4, and 5 is obtained on the block side first connection end of the present embodiment by making it have the above-mentioned configuration.

INDUSTRIAL APPLICABILITY

According to the present invention, the fusible body can be incorporated into the circuit body by connecting one side of the fusible body to the block side first connection end and connecting the other side of the fusible body to the block side second connection end. In this case, since the fusible body is made detachable relative to the block side first connection end and the block side second connection end, the fusible body that has been set to the resistance value commensurate with the required fuse capacity can be incorporated into the circuit body. In addition, the fusible body that has fused after the fusible body has fused can be readily removed, and also in a case where the new fusible body is to be incorporated into the circuit body, the fusible body can be readily incorporated into the block side first connection end and the block side second connection end in comparison with joining of the fusible body by welding, swaging and so forth.

REFERENCE SIGNS LIST

1 fuse unit
2 resin housing
3 circuit body
4 fusible body
10 fusible body containing part
13 cover
14 front side element cover
15 back side element cover
17 block side circuit body
18 block side terminal body
25, 32 block side first connection end
27 block side first connection part
28 cut-upright base part
29 cut-upright elastic part
40 block side second connection end
42 block side second connection part

The invention claimed is:

1. A fuse unit, comprising:

a resin housing that is formed by an insulator;

a circuit body that is formed by a conductor, is molded integrally with the resin housing and branches and transfers electric power from a power source side to a load side; and a fusible body that is provided on the circuit body and fuses at overcurrent to the load side, wherein the circuit body is formed by a block side circuit body to be connected to the power source side, and a block side terminal body to be connected to the load side, a block side first connection end to which one side of the fusible body is to be detachably connected is formed on the block side circuit body, a block side second connection end to which the other side of the fusible body is to be detachably connected is formed on the block side terminal body, the block side first connection end and the block side second connection end are provided on a plurality of places and a plurality of the fusible bodies is connected thereto, and partition ribs partition the adjacent fusible bodies, the partition ribs are respectively formed on a cover that includes a front side element cover and a back side element cover.

2. The fuse unit according to claim 1, wherein each of the block side first connection end and the block side second connection end is formed by a cut-upright base part that is cut upright from the circuit body, and a cut-upright elastic part that is bent from the cut-upright base part in a plane direction of the circuit body to insert one side of the fusible body into between the cut-upright elastic part and the circuit body so as to enable elastic nipping and holding.

3. The fuse unit according to claim 1, wherein the partition ribs of the front side element cover and the back side element cover mutually abut in a state of covering a fusible body containing part and partition the adjacent fusible bodies.

* * * * *